US005125644A

United States Patent [19]

Masaki et al.

[11] Patent Number: 5,125,644

[45] Date of Patent: Jun. 30, 1992

[54] SEPARATING DEVICE FOR SHEET-LIKE MEMBER INCLUDING SEPARATING PAWL COATED WITH AMORPHOUS CARBON LAYER

[75] Inventors: Kenji Masaki; Shuji Iino; Isao Doi; Izumi Osawa, all of Osaka, Japan

[73] Assignee: Minolta Camera Kabushiki Kaisha, Osaka, Japan

[21] Appl. No.: 558,659

[22] Filed: Jul. 26, 1990

[30] Foreign Application Priority Data

Aug. 4, 1989 [JP] Japan ..... 1-204139

[51] Int. Cl.[5] ..... B65H 29/56

[52] U.S. Cl. ..... 271/308; 271/900; 118/245; 355/315

[58] Field of Search ..... 271/308, 306-313, 271/900; 118/245; 355/315

[56] References Cited

U.S. PATENT DOCUMENTS

| | | | |
|---|---|---|---|
| 4,824,753 | 4/1989 | Hotomi et al. | 430/108 |
| 4,836,136 | 6/1989 | Natsuhara | 118/657 |
| 4,847,653 | 7/1989 | Doi et al. | 355/245 |
| 4,893,146 | 1/1990 | Tachibana | 271/308 X |

FOREIGN PATENT DOCUMENTS

| | | |
|---|---|---|
| 56-3535 | 1/1981 | Japan . |
| 57-27285 | 2/1982 | Japan . |
| 60-162275 | 8/1985 | Japan . |
| 61-277985 | 12/1986 | Japan . |
| 1-90484 | 4/1989 | Japan . |

*Primary Examiner*—Richard A. Schacher

*Attorney, Agent, or Firm*—Willian Brinks Olds Hofer Gilson & Lione

[57] ABSTRACT

This invention relates to a separating pawl installed in a copying machine wherein at least an edge of the separating pawl is composed of an amorphous carbon layer; the edge of the separating pawl being in contact with a surface of a photosensitive member or a surface of a fixing roller to separate a sheet like member.

31 Claims, 5 Drawing Sheets

SEPARATING DEVICE FOR SHEET-LIKE MEMBER INCLUDING SEPARATING PAWL COATED WITH AMORPHOUS CARBON LAYER

BACKGROUND OF THE INVENTION

The present invention relates to a separating device for a sheet-like member used in an electronic copying machine, a printer, a facsimile and the like, in particular to a separating device with a separating pawl for separating a sheet-like member from members to be separated, such as a photosensitive member, a fixing roller and other media such as an intermediate transfer member used in a multi-color development, by pawl.

When a toner image is transferred onto a sheet-like member, such as transfer paper, from a photosensitive member or an intermediate transfer member used in a multi-color development, in particular, when the photosensitive member having a large radius of curvature and the intermediate transfer member having a large radius of carvature or the sheet-like member having a small stiffness is used, the sheet-like member is wound around the photosensitive member or the intermediate transfer member due to an electrostatic attraction and the like.

The sheet-like member is also apt to be curled to a great extent by a heat in a fixation process so as to wind around fixing rollers, when the toner image transferred onto the sheet-like member is fixed on the sheet-like member by means of the fixing rollers.

Accordingly, separating pawls have been used at these places to be brought into contact with the photosensitive member, the intermediate transfer member and the fixing roller, whereby the separating pawls separate the sheet-like member from the photosensitive member, the intermediate transfer member and the fixing roller.

A large number of performances have been required for such the separating pawls.

At first, smoothness and sliding properties are required. If the separating pawl is poor in smoothness, a surface of the photosensitive member is scratched in contact with the separating pawl, and an electrostatic charge is not given to these scratched portions, resulting in the formation of white-striped noises in copied images. Moreover, these injured portions are filled with toners to interrupt the irradiation of light. Therefore, the surface potential does not decrease, resulting in the formation of black-striped noises in copied images. In particular, organic photosensitive members, which have been widely used in recent years, have exhibited remarkably such the problems due to the softness of the surface thereof.

The separating pawl for separating a sheet-like member from fixing rollers also wears a surface of the fixing rollers.

Then, it is required that a toner does not adhere to the separating pawl. If a toner particle adheres to the separating pawl, the adhered toner particles fall onto the sheet-like member in contact with the photosensitive member or the fixing roller, resulting in black spot-like noises in copied images. Moreover, the adhered toner particles are fused by heat generated by the friction of the photosensitive member with the separating pawl or by heat of the fixing rollers to fix onto a surface of the separating pawl. The fixation of toner particles causes the obstruction of the normal contact of the separating pawl with the photosensitive member or the fixing roller, resulting in the failure of the separation of the sheet-like member, such as transfer paper.

The adherence of toner particles to the separating pawl for separating the sheet-like member from the photosensitive member is observed outstandingly at high temperature and under high humid condition. Therefore, it is also required that the separating pawl is excellent in water repellancy.

Such the adherence is often observed when the surface of the photosensitive member is formed of an amorphous carbon layer. This reason is not necessarily clear, but it is thought that the amorphous carbon is very active to charge electrically the separating pawl. Therefore, toner particles are liable to adhere to the separating pawl electrostatically.

It is further required that the separating pawl is excellent in wear resistance. There is a problem as to wear resistance when the separating pawl is mainly composed of resin components.

SUMMARY OF THE INVENTION

The present invention is to solve the above described problems caused when a sheet-like member is separated from members to be separated, such as a photosensitive member, fixing rollers and an intermediate transfer member used in the multi-color development, by means of a separating pawl.

The object of the present invention is to provide a separating pawl excellent in smoothness, which does not wear a photosensitive member and/or a fixing roller.

Another object of the present invention is to provide a separating pawl excellent in the resistance to adherence of a toner, even under high-temperature and high humidity conditions, in particular, when used in combination with a photosensitive member having a surface layer of amorphous carbon.

Another object of the present invention is to provide a separating pawl excellent in wear resistance.

These objects are achieved by forming at least a portion, which is brought into contact with the members to be separated, of the separating pawl of an amorphous carbon layer (hereinafter referred to as a-C layer) in a separating device for separating the sheet-like member from the members to be separated, such as a photosensitive member, an intermediate transfer member and fixing rollers, by means of the separating pawl.

DETAILED DESCRIPTION OF THE INVENTION

Figure 1:
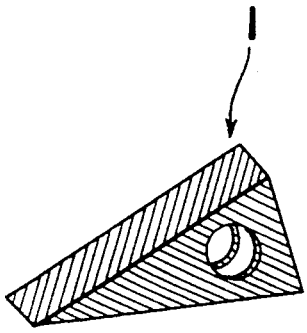
FIG. 1 is a schematical perspective view showing one example of a separating pawl used in the present invention.

The present invention provides a separating device for separating a sheet-like member including a separating pawl in engaging contact with a surface from which the sheet-like member is separated, the contact portion of the separating pawl being formed of an amorphous carbon layer.

The amorphous carbon layer used in the invention may be the one prepared by plasma-polymerizing a compound containing at least a carbon atom.

Such the compounds include alcohols, ketones, carboxylic acids, amines, amides, esters, ethers, halogenated hydrocarbons and the like in addition to saturated hydrocarbons, unsaturated hydrocarbons, alicyclic hydrocarbons, aromatic hydrocarbons and the like.

Saturated hydrocarbons are exemplified by;

normal-paraffins—methane, ethane, propane, butane, pentane, hexane, heptane, octane, nonane, decane, undecane, dodecane, tridecane, tetradecane, pentadecane, hexadecane, heptadecane, octadecane, nonadecane, eicosane, heneicosane, docosane, tricosane, tetracosane, pentacosane, hexacosane, heptacosane, octacosane, nonacosane, triacontane, dotriacontane, pentatriacontane, etc.; and isoparaffins—isobutane, isopentane, neopentane, isohexane, neohexane, 2,3-dimethylbutane, 2-methylhexane, 3-ethylpentane, 2,2-dimethylpentane, 2,4-dimethylpentane, 3,3-dimethylpentane, triptane, 2-methylheptane, 3-methylheptane, 2,2-dimethylhexane, 2,2,5-dimethylhexane, 2,2,3-trimethylpentane, 2,2,4-trimethylpentane, 2,3,3-trimethylpentane, 2,3,4-trimethylpentane,. isononane, etc.

Unsaturated hydrocarbons are exemplified by;

olefins—ethylene, propylene, isobutylene, 1-butene, 2-butene, 1-pentene, 2-pentene, 2-methyl-1-butene, 3-methyl-1-butene, 2-methyl-2-butene, 1-hexene, tetramethylethylene, 1-heptene, 1-octene, 1-nonene, 1-decene, etc.;

diolefins—allene, methylallene, butadiene, pentadiene, hexadiene, cyclopentadiene, etc.; and triolefins —ocimene, allo-ocimene, myrcene, hexatriene, etc.

acetylenes—acetylene, methylacetylene, 1-butyne, 2-butyne, 1-pentyne, 1-hexyne, 1-heptyne, 1-octyne, 1-nonyne, and 1-decyne.

Alicyclic hydrocarbons are exemplified by;

cycloparaffins—cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane, etc.;

cycloolefins—cyclopropene, cyclobutene, cyclopentene, cyclohexene, cycloheptene, cyclooctene, cyclononene, cyclodecene, etc.;

terpenes—limonene, terpinolene, phellandrene, silvestrene, thujene, caren, pinene, bornylene, camphene, fenchene, cyclofenchene, tricyclene, bisabolene, zingiberene, curcumene, humulene, cadine-sesquibenihen, selinene, caryophyllene, santalene, cedrene, camphorene, phyllocladene, podocarprene, mirene, etc.; and steroids.

Aromatic hydrocarbons are exemplified by;

benzene, toluene, xylene, hemimellitene, pseudocumene, mesitylene, prehnitene, isodurene, durene, pentamethyl benzene, hexamethyl benzene, ethylbenzene, propyl benzene, cumene, styrene, biphenyl, terphenyl, diphenylmethane, triphenylmethane, dibenzyl, stilbene, indene, naphthalene, tetralin, anthracene, and phenanthrene.

Compounds used for a plasma-polymerization are not always gaseous at normal temperature and normal pressure. Any compound may be used so far as it is capable of being gasified through the melting, the evaporation, the sublimation and the like by heating or depressurizing.

In addition, a carrier gas may be used in addition to the above described raw material compounds. $H_2$, Ar, Ne, He and the like are suitable as the carrier gas.

It is most preferable process for the formation of an a-C layer that a gaseous raw material undergoes plasma states formed by a plasma method using a direct current, a low-frequency wave, a high-frequency wave, a microwave and the like. A gaseous raw material may undergo ionic states formed by an ionization vapour deposition method or an ion-beam vapour deposition method to form the a-C layer.

An a-C layer may be formed from neutral particles of raw materials by a sputtering method or a photo CVD method. The formation method of an a-C layer as above mentioned may be used singly or in combination.

A content of hydrogen atoms contained in an a-C layer according to the present invention may be changed depending upon the type of a layer-forming apparatus and layer-forming conditions. In order to reduce the content of hydrogen atoms, for example, a substrate temperature is increased, a pressure being reduced, a dilution ratio of a raw material gas being reduced, a voltage applied being increased, a frequency of an alternating electric field being reduced, and an intensity of a direct electric field overlapped on the alternating electric field being increased. These conditions may be adequately adjusted so that the effects of the present invention may not be hindered.

Concretely speaking, hydrogen atoms are contained at a content of 0.1 to 67 atomic %, preferably 20 to 60 atomic %, based on the number of all atoms in the a-C layer. If the hydrogen atoms are contained at a content of less than 0.1 atomic %, the fragility of the a-C layer is increased, whereby the a-C layer is apt to be cracked by a slight impact. If the hydrogen atoms are contained at a content of more than 67 atomic %, the layer-forming property is deteriorated and the hardness of the a-C layer is reduced, whereby the a-C layer is poor in durability.

The structure of an a-C layer according to the present invention, the content of carbon atoms contained in the a-C layer and the content of hydrogen atoms contained in the a-C lay may be measured by the normal analytical methods of elements such as an organic elemental analysis, an infrared absorption analysis, a X-ray diffraction method, $^1$H-NMR and $^{13}$C-NMR.

An a-C layer according to the present invention is a thin layer having a thickness of about 0.1 to 500 μm, preferably about 5 to 100 μm, and capable of giving a sufficient separating efficiency to a separating pawl.

If the thickness of the a-C layer is less than 0.1 μm, it is difficult to ensure the sufficient durability. If the thickness of the a-C layer is larger than 500 μm, it is difficult to form an uniform a-C layer on the separating pawl with high accuracy.

The thickness of the a-C layer may be suitably adjusted within the above described range depending upon the material, the form and the like of a substrate to be coated with the a-C layer. In general, when the substrate is low in hardness, it is desirable to increase the thickness of the a-C layer.

For example, when the substrate having a high surface hardness, such as stainless steels, reinforced glass and the like, is used, the thickness of the a-C layer is set at about 0.1 to 20 μm.

When the substrate having a low surface hardness, such as resins and rubbers, is used, the thickness of the a-C layer is set at about 5 to 500 μm.

Fluorine atoms may be incorporated in an a-C layer to improve the sliding properties of the a-C layer against the member to be separated or to shift the frictionally chargeable polarity due to the contact of the a-C layer with the member to be separated toward the negative side.

Preferable content of fluorine atoms is 1–67 atomic % on the basis of the number of all atoms in the a-C layer. If the content is less than 1 atomic % or less, the improvement of the sliding properties and the shift of the frictionally chargeable polarity can not achieved. If the content is more than 67 atomic %, an obtained a-C layer is flexibile and there arises a problem with respect to durability.

In order to introduce fluorine atoms into the a-C layer, a mixture gas comprising the raw material gases and fluorine-containing compounds may be used as a raw material gas for the plasma polymerization.

Fluorine-containing compounds are not always gaseous at normal temperature and normal pressure. Any compound containing fluorine atoms may be used so far as it is capable of being gasified through the melting, the evaporation, the sublimination and the like by heating or depressurizing.

Fluorine-containing compounds are exemplified by inorganic compounds, such as fluorine, hydrogen fluoride, chlorine fluoride, bromine fluoride, iodine fluoride, sulfur fluoride, oxygen fluoride, arsine fluoride, borone fluoride, silicon fluoride, ammonium hydrogen fluoride, potassium hydrogen fluoride, sulfuryl fluoride, selenium fluoride, thionyl fluoride, thiophophoryl fluoride, nitrogen fluoride, tellurium fluoride, niobium fluoride, nitryl fluoride, nitrosyl fluoride, cyan fluoride and phosphoryl fluoride, or organic compounds, such as methyl fluoride, ethyl fluoride, propyl fluoride, butyl fluoride, amyl fluoride, hexyl fluoride, heptyl fluoride, octyl fluoride, nonyl fluoride, decyl fluoride, ethylene fluoride, butylene fluoride, butadiene fluoride, acetyl fluoride, vinylidene fluoride, fluorobenzene, fluorostyrene, fluoroform, oxalyl fluoride, carbonyl fluoride, ethylidene fluoride, aryl fluoride, chlomyl fluoride and cyano fluoride.

In addition, metallic atoms may be incorporated into an a-C layer to give an electric conductivity to the a-C layer or reduce an electric resistance of the a-C layer when it is required to reduce the frictional chargeability due to the contact of the a-C layer with the member to be separated.

Preferable content of the metal is 0.1–30 atomic on the basis of the number of all atoms in the a-C layer. If the content is less than 0.1 atomic %, the electric resistance does not decrease. If the content is more than 30 atomic %, the obtained layer is fragile and liable to crack and break off in the plasma-polymerization process.

Metal-containing compounds are not always gaseous at normal temperature and normal pressure. Any compound containing metal atoms may be used so far as it is capable of being gasified through the melting, the evaporation, the sublimination and the like by heating or depressurizing.

Al:$Al(Oi\text{-}C_3H_7)_3$, $(CH_3)_3Al$, $(C_2H_5)_3Al$, $(i\text{-}C_4H_3)_3Al$, $AlCl_3$
Ba:$Ba(OC_2H_5)_3$
Ca:$Ca(OC_2H_5)_3$
Fe:$Fe(Oi\text{-}C_3H_7)_3$, $(C_2H_5)_2Fe$, $Fe(CO)_5$
Ga:$Ga(Oi\text{-}C_3H_7)_3$, $(CH_3)_3Ga$, $(C_2H_5)_3Ga$, $GaCl_3$, $GaBr_3$
Ge:$GeH_4$, $GeCl_4$, $Ge(OC_2H_5)_4$, $Ge(C_2H_4)_4$
Hf:$Hf(Oi\text{-}C_3H_7)_4$
In:$In(Oi\text{-}C_3H_7)_3$, $(C_2H_5)_2In$
K:$KOi\text{-}C_3H_7$
La:$La(Oi\text{-}C_3H_7)_4$
Mg:$Mg(OC_2H_5)_2$, $(C_2H_5)_{Mg}$
Na:$NaOi\text{-}C_3H_7$
Nb:$Nb(OC_2H_5)_5$
Sb:$Sb(OC_2H_5)_3$, $SbCl_3$, $SbH_3$
Sr:$Sr(OCH_3)_2$
Ti:$Ti(Oi\text{-}C_3H_7)_4$, $Ti(OC_4H_9)_4$, $Ti\ Cl_4$
Si:$SiH_4$, $Si_2H_6$, $(C_2H_5)_3SiH$, $SiF_4$, $SiH_2Cl_2$, $SiCl_4$, $Si(OCH_3)_4$, $Si(OC_2H_5)_4$
Ta:$Ta(OC_2H_5)_5$
V:$VO(OC_2H_5)_3$, $VO(Ot\text{-}C_4H_9)_3$
Y: $Y(Oi\text{-}C_3H_7)_3$
Zn:$Zn(OC_2H_5)_2$, $(CH_3)_2Zn$, $(C_2H_5)_2Zn$
Zr:$Zr(Oi\text{-}C_3H_7)_4$
Sn:$(CH_3)_4Sn$, $(C_2H_5)_4Sn$, $SnCl_4$
Cd:$(CH_3)_2Cd$
Co:$Co_2(CO)_5$
Cr:$Cr(CO)_6$
Mn:$Mn_2(CO)_{10}$
Mo:$Mo(CO)_6$, $MoF_6$, $MOCl_6$
W:$W(CO)_6$, $WCl_6$, $WF_6$
and the like.

In addition, vinyl metal-containing monomers, metal phthalocyanine and the like may be used.

Furthermore, oxygen atoms and/or nitrogen atoms may be incorporated in an a-C layer to increase long-time stability of the a-C layer.

Preferable content of nitrogen atoms and/or oxygen atoms is 0.1–20 atomic % on the basis of the number of all atoms in the a-C layer. If the content is less than 0.1 atomic %, the long-time stability may not be achieved. For example, when the a-C layer formed on a substrate is left to stand for a long time, the a-C layer may be cracked or separated from the substrate. If the content is more than 20 atomic %, the obtained layer is fragile and liable to crack and break off in the plasma-polymerization process.

Atoms of the III group, IV group, V group and the like in the Periodic Table may be also incorporated in an a-C layer in order to control the frictionally chargeable polarity.

Preferable content of those atoms is 0.01–30 atomic % on the basis of the number of all atoms in the a-C layer. The incorporation of the atoms of group III and/or IV effects to shift the frictionally chargeable polarity to the negative (−) side and the incorporation of the atoms of group V effects to shift the same to the positive side (+). If the content of atoms of the group III, IV and/or V is more than 30 atomic %, the obtained layer is fragile and liable to crack and break off in the plasma-polymerization process.

Besides, when a substrate of a separating pawl is formed of materials which are particularly poor in adhesion to an a-C layer or, a substrate of a separating pawl is subjected to some treatment so that the adhesion of the a-C layer to the substrate may become poor, an undercoating layer may be formed on the substrate prior to the formation of the a-C layer.

Such the undercoating layer may be formed of a-Si:C:H, a-Si:H, a-Ge:H, a-N:B:H and a-C: Al:H, which can be prepared by a plasmatic reaction in the same manner as an a-C layer.

Figure 2:
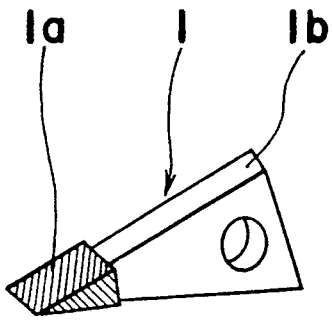
FIG. 2 is a schematical perspective view showing another example of the separating pawl used in the present invention.

The separating pawl, for example, of a wedge type may be coated wholly with an a-C layer as shown in FIG. 1. Only the wedge portion (1*a*), which is to be brought into contact with a surface of a member to be separated such as a photosensitive member, an intermediate transfer member and a fixing roller may be coated with the a-C layer and the remaining portion (1*b*) may be formed of metals, synthetic resin and the like, as shown in FIG. 2.

Figure 3:
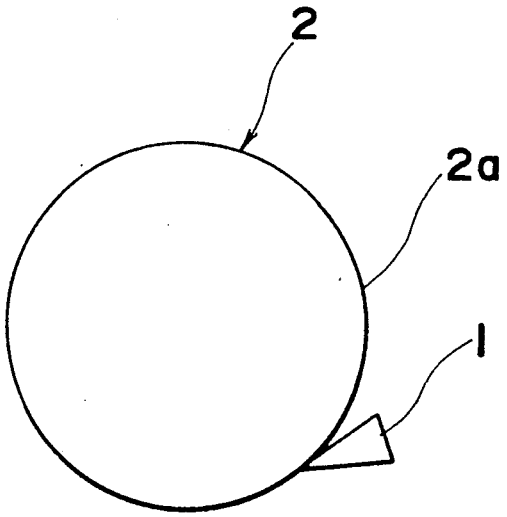
FIG. 3 is a side view showing a state of the contact of an edge of a separating pawl with a photosensitive member.
Figure 4:
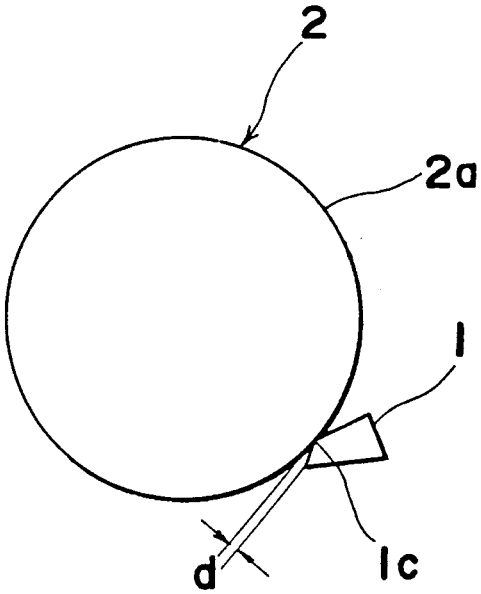
FIG. 4 is a side view showing a state of the contact of an abdomen of a separating pawl with a surface of a photosensitive member.

When a separating pawl, which is prepared in the above described manner, is brought into contact with a photosensitive member, the separating pawl (1) formed in a wedge-like shape as shown in FIG. 1 may be brought into contact with a surface (2*a*) of the photosensitive member(2) at an edge thereof, as shown in FIG. 3. An expanded abdomen (1*c*) may be formed at a position slightly distant from an edge of a separating pawl (1), and the abdomen (1*c*) may be brought into contact with a surface (2*a*) of the photosensitive member (2), as shown in FIG. 4. With respect to this abdomen type separating pawl (1) whose edge (1*d*) does not contact with the surface (2*a*), it is desirable that an distance between the pointed end of the separating pawl (1) and the surface (2*a*) of the photosensitive member (2) is adjusted at ½ or less times the thickness of the sheet-like member to be separated to ensure the separation of the sheet-like member.

Figure 5:
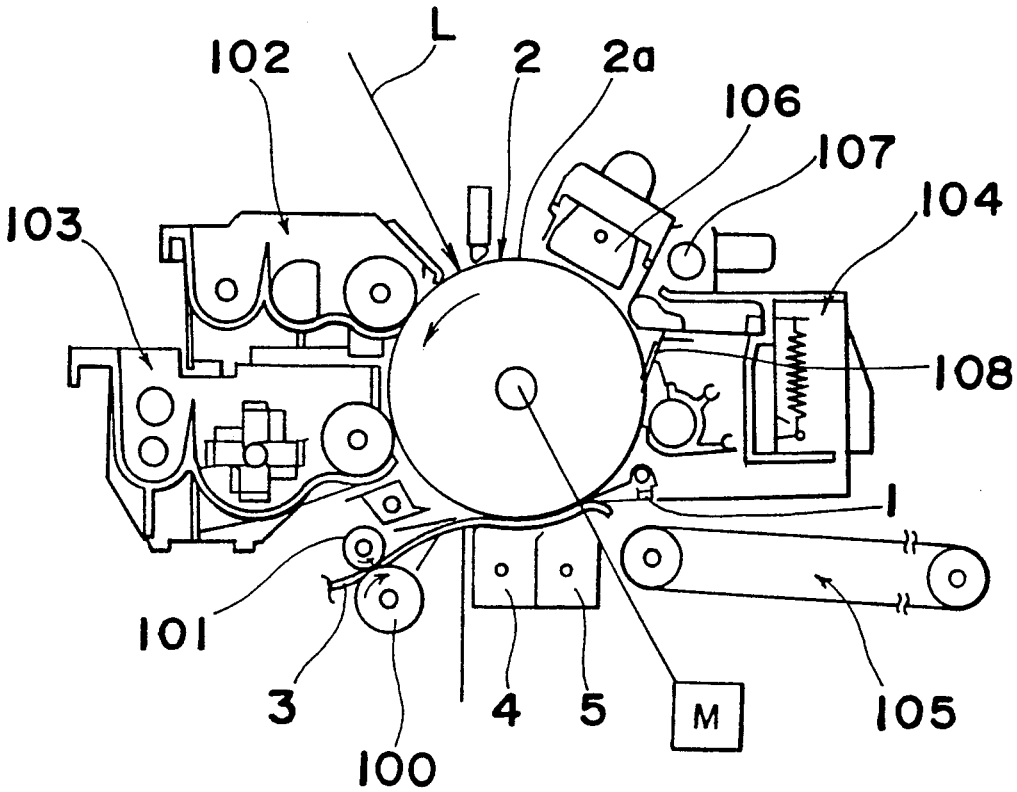
FIG. 5 is a schematical sectional view of a copying machine to show conceptually how to separate sheet-like member from a surface of a photosensitive member by a separating pawl.

A separating pawl is installed in a copying machine as shown in FIG. 5. FIG. 5 shows how to separate a sheet-like member (3) from the surface (2*a*) of the photosensitive member (2) by the separating pawl (1). The photosensitive member is revolved in the direction of the arrow in the FIG. 5 with the help of a motor (M). The surface (2*a*) of the photosensitive member (2) is uniformly charged by a charger (106), and then it is irradiated by light (L) according to images to be copied for the formation of electrostatic latent images thereon. The electrostatic latent images are made visible by toner particles with a developing device (102) or (103). The timing rollers (101) and (102) rotates on a specified timing so as to lead the sheet-like member (3) to the photosensitive member.

Toner images on the surface of the photosensitive member are transferred onto the sheet-like member (3) by a charger (4) in a transferring process and a charger(5) in a separating process. Then, the edge of the separating pawl (1) is brought into contact with the surface (2*a*) of the photosensitive member (2) to separate the sheet-like member on which the toner images are transferred from the photosensitive member (2). The separated sheet-like member (3) is lead to a fixing device (not shown) by a conveyer (105). The residual toner particles on the photosensitive member (2) are recovered by a blade (108) in a cleaner (104) and the residual potential is erased by an erasing lamp (107). Then, the above mentioned process is repeated again.

Figure 6:
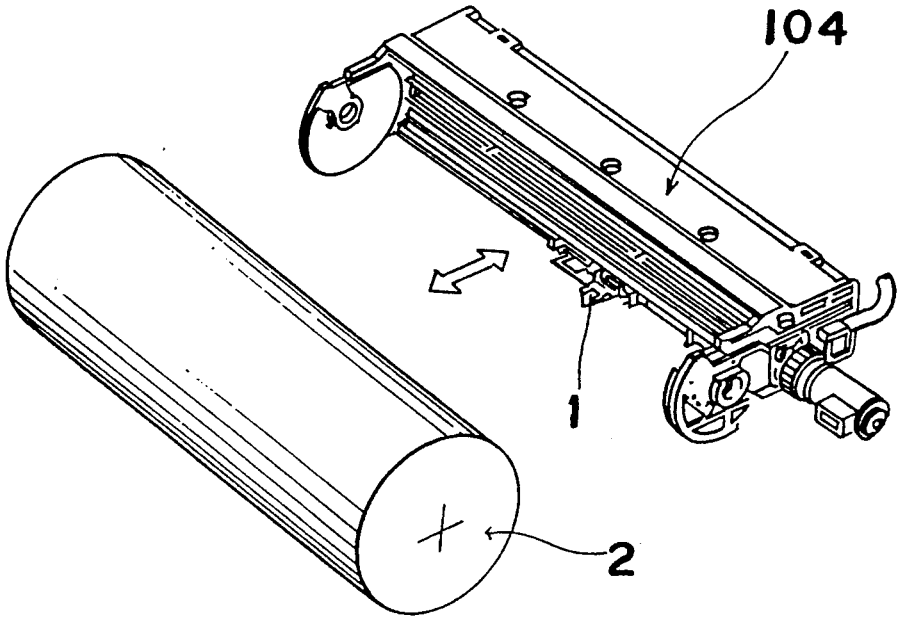
FIG. 6 is a schematical perspective view of a cleaner equipped with a separating pawl, to which a photosensitive member is detatchable.

As above mentioned, the separating pawl is positioned between the chargers (4), (5) and the cleaner (104). In another embodiment, the separating pawl (1) may be equipped in one body at the lower position of the cleaner as shown in FIG. 6. FIG. 6 shows the cleared to which the photosensitive member (2) is detachable.

When the separating pawl (1) is brought into contact with the surface (2*a*) of the photosensitive member (2) to separate the sheet-like member, if the separating pawl (1) is always brought into contact with the surface (2*a*) of the photosensitive member (2) at a constant position thereof, a contact memory may occur on the photosensitive member (2). Therefore, it is desirable that the separating pawl (1) is brought into contact with the surface (2*a*) of the photosensitive member (2) only when the sheet-like member reaches the separating pawl in synchronization with a timing of the passing of the sheet-like member on the photosensitive member (2). When it is not necessary to separate the sheet-like member, the separating pawl is not in contact with the photosensitive member. The separating pawl (1) may be rocked in an axial direction of the photosensitive member (2).

Figure 7:
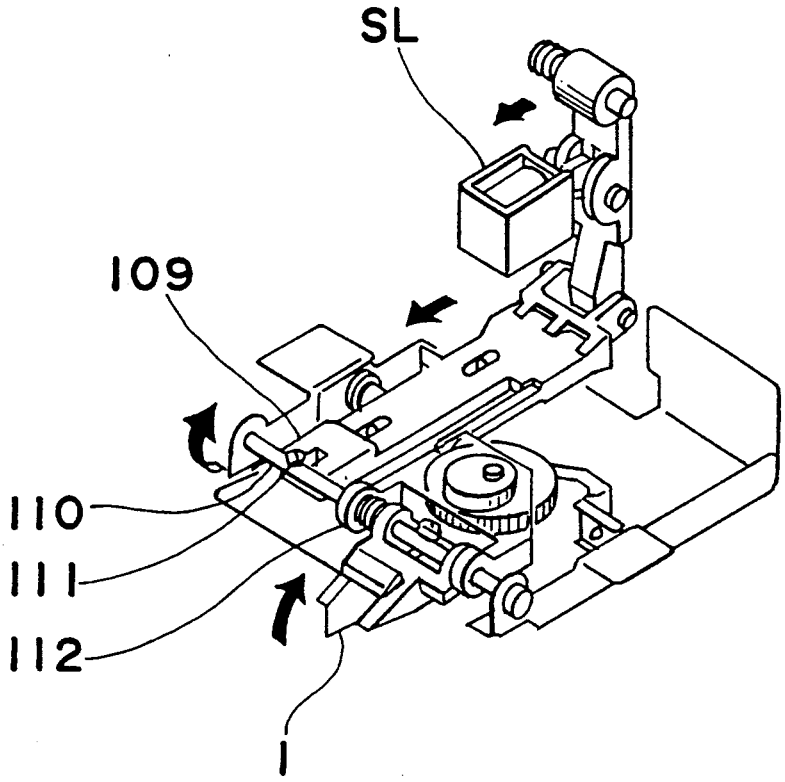
FIG. 7 and FIG. 8 show to explain the movements of separating pawls.
Figure 8:
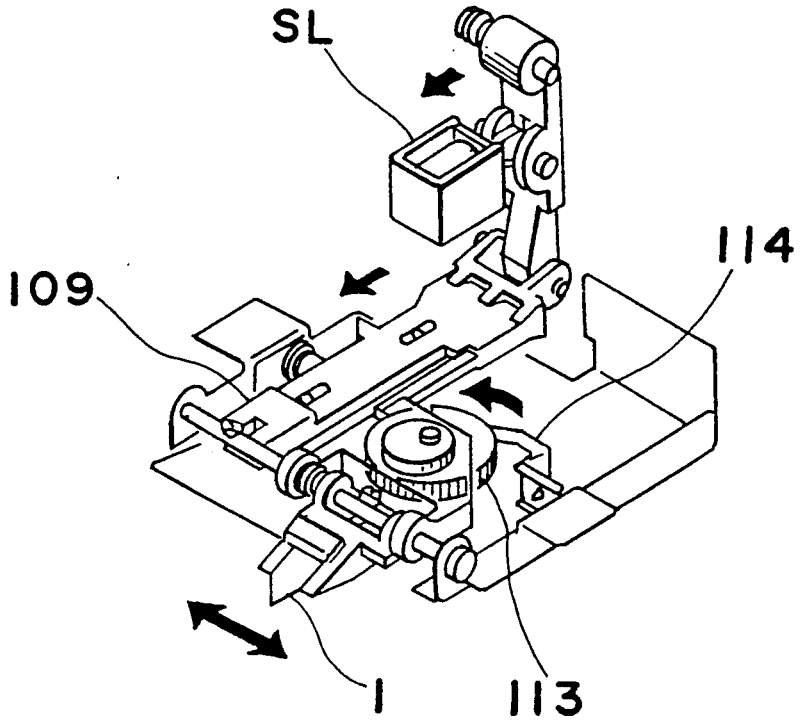

The mechanisms shown in FIG. 7 or FIG. 8 may achieve such movements as above mentioned.

In FIG. 7, a solenoid (SL) for the separating pawl (1) is turned off and the separating pawl (1) is not in contact with the photosensitive member until the sheet-like member reaches a predetermined position. The predetermined position means,, for example, the position of the sheet-like member after the sheet-like member is introduced through between the timing rollers (100) and (101) to the photosensitive member for a specified time in FIG. 5. After the predetermined portion is detected by a detector (not shown), the solenoid (SL) is turned on for a specified time to press the separating pawl against the surface of the photosensitive member. When the solenoid is turned on, a transport pawl (109) moves in the direction of the arrow in FIG. 7. Thereby, a connecting pin (111) connected to an axis (110) for the separating pawl is pushed to revolve the axis in the direction of the arrow shown in FIG. 7. Accordingly, the separating pawl connected to the same axis (110) is brought into contact with the surface of the photosensitive member. The pressure of the separating pawl against the photosensitive member is controlled by a spring (112).

FIG. 8 explains the separating pawl which is pressed against the photosensitive member and can rock in the axial direction of the photosensitive member.

In FIG. 8, when the solenoid (SL) for the separating pawl is turned on, the transport pawl (109) revolves one tooth of an eccentric cam ratchet(113) in counter clockwise direction. Accordingly, the separating pawl moves in the revolving direction of the eccentric cam ratchet. When the solenoid for the separating pawl is turned off, a counter-revolution stopping pawl(114) prevents the eccentric cam ratchet from counter revolution.

A separating pawl of the invention is very effective to achieve the objects of the present invention when used in combination with a photosensitive member, the surface of which is formed of an amorphous carbon layer.

The amorphous carbon layer is excellent as a surface protective material of the photosensitive member.

However, when a conventional separating pawl is used in combination with the photosensitive member, a toner particle is liable to adhere to the conventional separating pawl. The adhered toner particles fall onto a sheet-like member, resulting in noises in copied images. The amount of toner particles adhering to the separating pawl decreases when the separating pawl is coated with the same amorphous carbon layer as that of the surface protective layer. It is thought that because a frictional electrification rank of the separating pawl is far from that of the surface of the photosensitive member, the separating pawl is electrically charged by the friction therebetween, and therefore a toner particle adheres to the separating pawl. When both the separating pawl and the surface of the photosensitive member are formed of an amorphous carbon layer, the separating pawl comes to be hard to be charged electrically.

Figure 9:
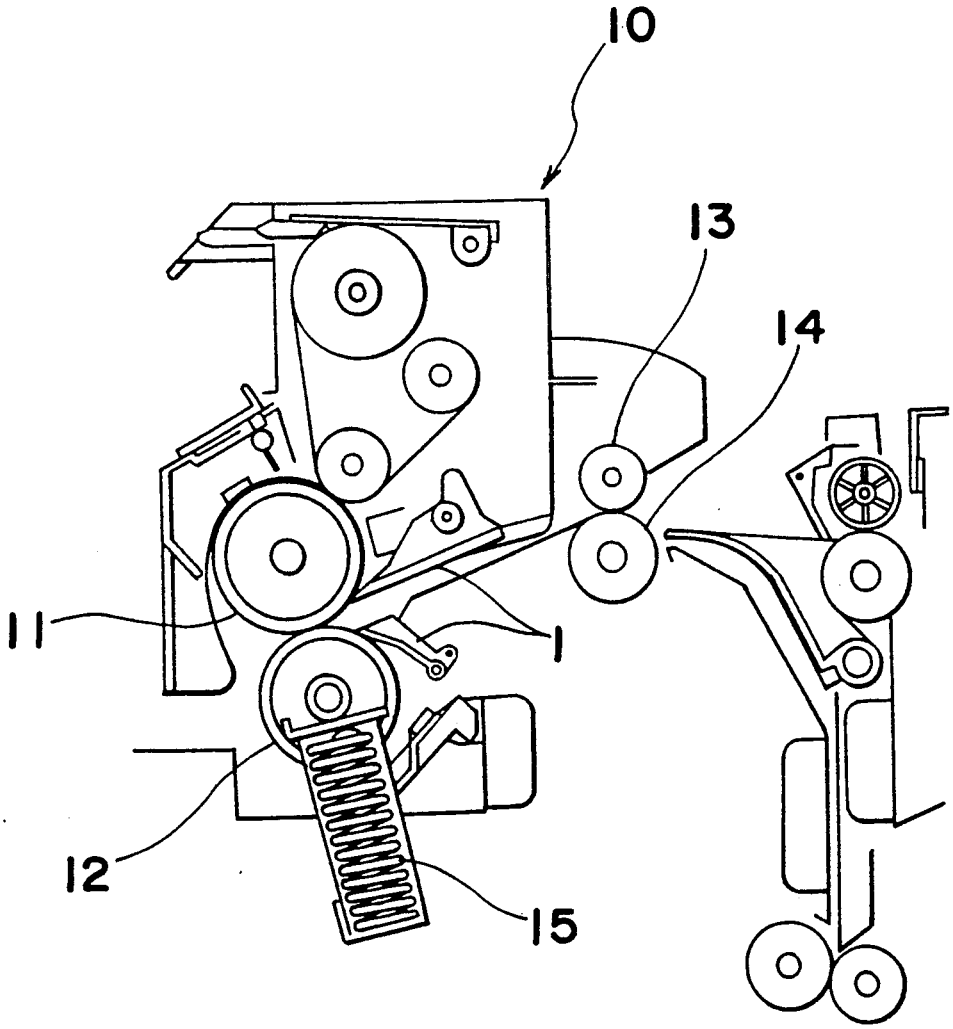
FIG. 9 is a schematical sectional view showing a state of the contacts of separating pawls with a pair of an upper fixing roller and a lower fixing roller to separate a sheet-like member from the fixing rollers.

When a separating pawl is installed in a fixing device, the separating pawl is usually brought into contact with a surface of the upper roller (11) of a pair of fixing rollers (11), (12) shown in FIG. 9, but the sheet-like member is apt to be wound also around the lower roller (12) in a copying machine, which has been recently increasingly widely used, capable of forming copied images on both sides of the sheet-like member, so that it is desirable that the above described separating pawl (1) is brought into contact with also the lower roller (12), as shown in FIG. 9. An explanation will be given of preparations of the amorphous carbon coating according to the present invention.

Figure 10:
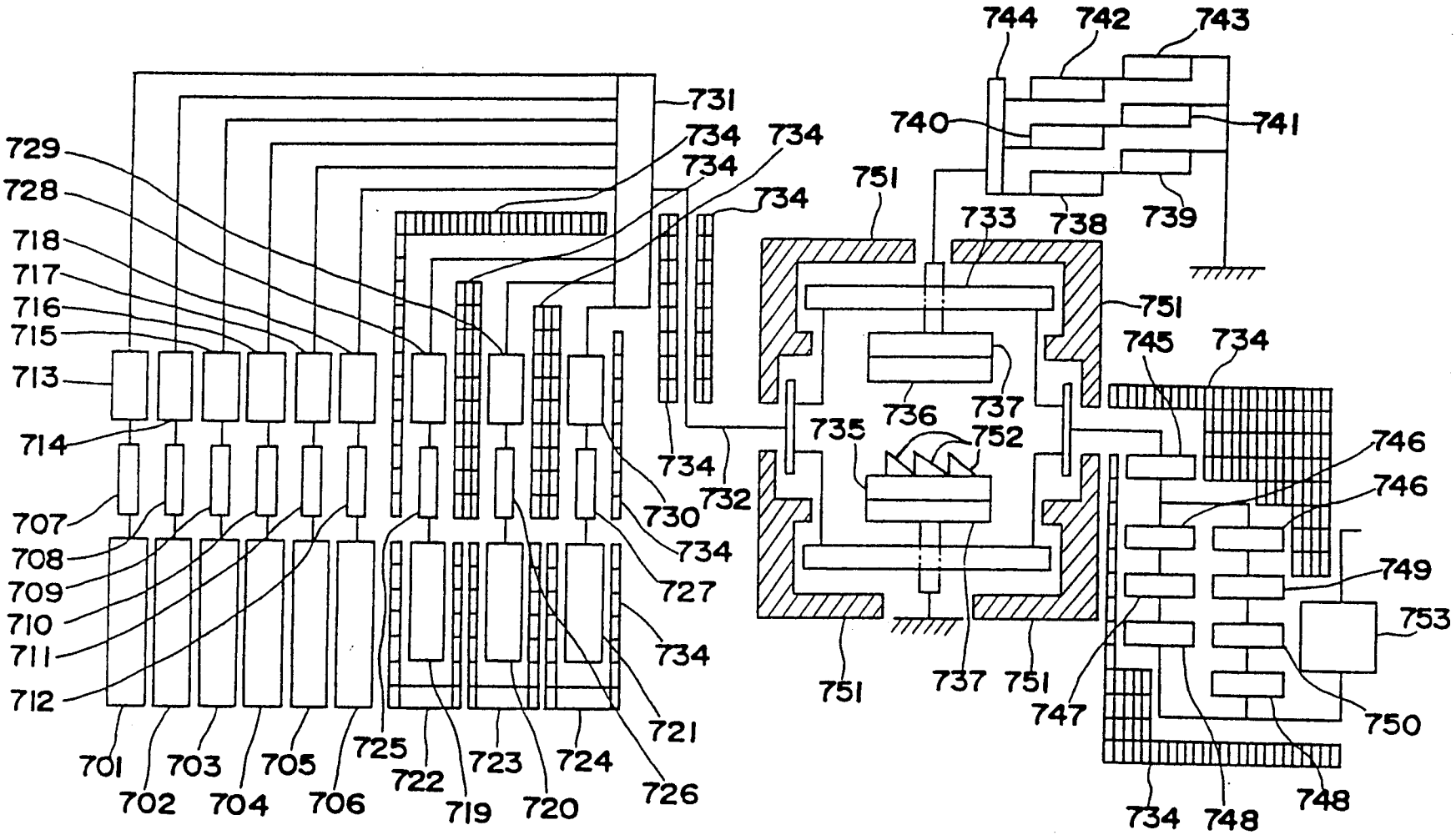
FIG. 10 is a schematical view of an apparatus for producing an amorphous carbon layer.

In FIG. 10, the numerals (701)-(706) denote No. 1 tank through No. 6 tank which are filled with a feedstock (a compound in the vapor phase at normal temperatures) and a carrier gas, each tank connected with one of six regulating valves No. 1 through No. 6 (707)-(712) and one of six flow controllers No. 1 through No. 6 (713)-(718).

The numerals (719)-(721) show vessels No. 1 through No. 3 which contain a feedstock which is a compound either in the liquid phase or in the solid phase at normal temperatures, each vessel being capable of being heated for vaporization by means of one of three heaters No. 1 through No. 3 (722)-(724). Each vessel is connected with one of three regulating valves No. 7 through No. 9 (725)-(727) and also with one of three flow controllers No. 7 through No. 9 (728)-(730).

These gases are mixed in a mixer (731) and sent through a main pipe (732) into a reactor (733). The piping is equipped at intervals with pipe heaters (734) so that the gases that are vaporized forms of the feedstock compounds in the liquid or solid state at normal temperatures are prevented from condensing or congealing in the pipes.

In the reaction chamber, there are a grounding electrode (735) and a power-applying electrode (736) installed oppositely, each electrode with a heater (737) for heating the electrode.

The power-applying electrode is connected to a high frequency power source (739) with a matching box (738) for high frequency power interposed in the connection circuit, to a low frequency power source (741) likewise with a matching box (740) for low frequency power, and to a direct current power source (743) with a low-pass filter (742) interposed in the connection circuit, so that by a connection-selecting switch (744) the mechanism permits application of electric power with a different frequency.

The pressure in the reaction chamber (733) can be adjusted by a pressure control valve (745), and the reduction of the pressure in the reaction chamber can be carried out through an exhaust system selecting valve (746) and by operating a diffusion pump (747) and an oil-sealed rotary vacuum pump (748) in combination or by operating a cooling-elimination device (749), a mechanical booster pump (750) and an oil-sealed rotary vacuum pump in combination.

The exhaust gas is discharged into the ambient air after conversion to a safe unharmful gas by a proper elimination device (753).

The piping in the exhaust system, too, is equipped with pipe heaters at intervals in the pipe lines so that the gases which are vaporized forms of feedstock compounds in the liquid or solid state at normal temperatures are prevented from condensing or congealing in the pipes.

For the same reason the reaction chamber, too, is equipped with a heater (751) for heating the chamber, and an electrode therein are provided with a conductive substrate (752) for the purpose.

The reaction chamber for the production of a-C layer is depressurized preliminarily to a level in the range of about $10^{-4}$ to $10^{-6}$ Torr by the diffusion pump, and then check the degree of vacuum and the gas absorbed inside the equipment is removed by the set procedure. Simultaneously, by the heater for electrode, the electrode and the conductive substrate fixed to the opposing electrode are heated to a given temperature.

Then, from six tanks, No. 1 through No. 6, and from three vessels, No. 1 through No. 3, gases of the raw materials are led into the reaction chamber by regulating the gas flows at constant rates using the nine flow controllers, No. 1 through No. 9 and simultaneously the pressure in the reaction chamber is reduced constantly to a specified level by a pressure regulating valve.

After the gas flows have stabilized, the connection-selecting switch is put in position for, for example, the high frequency power source so that high frequency power is supplied to the power-applying electrode. An electrical discharge begins between the two electrodes and an a-C layer in the solid state is formed on the conductive substrate with time.

Then, the first to ninth control valves are closed to sufficiently exhaust an inside of the reaction chamber. Here, the vacuum within the reaction chamber is broken to obtain a separating pawl coated with an a-C layer according to the present invention.

The preferred examples of the present invention will be below described and it will be made clear with reference to comparative examples that a transfer paper-separating device according to the preferred examples of the present invention is superior.

At first, preferred examples, in which a separating pawl is brought into contact with a photosensitive member to separate transfer-paper, are described.

EXAMPLE 1

In this example, a wedge-like separating pawl, all the surface of which was coated with an a-C layer, was prepared by the plasmatic reaction under the conditions shown in Table 1 in an apparatus as shown in FIG. 10. Thus a wedge-like separating pawl (1) formed of the a-C layer all over the surface thereof as shown in FIG. 1 was obtained.

The contents of carbon atoms and hydrogen atoms in the a-C layer are also shown in Table 1.

TABLE 1

| substrate | Polycarbonate ((Upilone) S-2000 manufactured by Mitsubishi Gas Kagaku K.K.) |
|---|---|
| Flow rate of butadiene | 80 sccm |
| Flow rate of hydrogen | 200 sccm |
| Pressure | 1.2 Torr |
| Frequency of electric Power | 150 KHz |
| Electric power | 200 W |
| Temperature of substrate | 50° C. |
| Layer-forming time | 90 minutes |
| Layer-thickness | 5 μm |
| Content of C | 52 atomic % |
| Content of H | 48 atomic % |

Then, transfer paper on the surface of which toner images were transferred was separated from the surface (2a) of the photosensitive member (2) by the separating pawl in accordance with the same procedures as explained in FIG. 5.

EXAMPLES 2 to 4

Separating pawls were produced under the conditions shown in Table 2 and an edge of these separating pawls (1) was brought into contact with a surface (2a) of the photosensitive ember (2) to separate transfer paper (3) from the surface (2a) of the photosensitive member (2).

TABLE 2

| Example No. | 2 | 3 | 4 |
|---|---|---|---|
| Substrate | Same as in EXAMPLE 1 | Same as in Example 1 | Monel metal |
| Raw material gas | Propylene | Butadiene | Butadiene |
| Flow rate | 200 sccm | 80 sccm Perfluoro-ethylene 40 sccm | 100 sccm Perfluoro-propylene 50 sccm |
| Carrier gas | Herium | Hydrogen | Hydrogen |
| Flow rate | 100 sccm | 200 sccm | 100 sccm |
| Pressure | 0.3 Torr | 1.0 Torr | 0.7 Torr |
| Frequency of electric power | 13.56 MHz | 80 KHz | 100 KHz |
| Electric power | 150 W | 200 W | 200 W |
| Temperature of substrate | 50° C. | 50° C. | 200° C. |
| Layer-forming time | 100 min. | 90 min. | 5 min. |
| Layer-thickness | 7 μm | 15 μm | 0.2 μm |
| Content of C | 64 atomic % | 53 atomic % | 52 atomic % |
| Content of H | 36 atomic % | 42 atomic % | 40 atomic % |
| Content of F | | 5 atomic % | 8 atomic % |

EVALUATION

Subsequently, the separating pawls, which were produced in the above described Examples 1, 2, were subjected to the durability test with respect to copy with varying a kind of transfer paper, operating conditions, such as temperature and humidity, and a ratio of toners adhering to the transfer paper in a copying machine (EP490Z manufactured by Minolta Camera K.K.) installed with photosensitive member, which is used under the negatively charged condition, to evaluate the performances of the respective separating pawls.

In addition, the separating pawls produced in Examples 3, 4 were similarly evaluated in a copying machine (EP570Z manufactured by Minolta Camera K.K.) installed with a selenium-arsine photosensitive member, which is used under the positively charged condition.

In the above described tests, a both-side copying process was repeated 10,000 times in all in the order of the following respective conditions i) to v).

i) the transfer paper having the weight of 64 g/m$^2$ was used and a manuscript having the black ratio of 6% was subjected to the both-side copying process 4,000 times under the atmospheric conditions that the temperature is 20° C. and the humidity is 65%.

ii) The transfer paper having the weight of 64 g/m$^2$ was used and a manuscript having the black ratio of 6% was subjected to the both side copying process 1000 times under the high-temperature and high-humidity atmospheric conditions that the temperature is 35° C. and the humidity is 85%.

iii) The transfer paper having the weight of 52 g/m$^2$ was used and a manuscript having the high black ratio of 50% was subjected to the both-side copying process 500 times under the high-temperature and high-humidity atmospheric conditions that the temperature is 35° C. and the humidity is 85%.

iv) The transfer paper having the weight of 104 g/m$^2$ was used and a manuscript having the high black ratio of 50% was subjected to the both-side copying process 500 times under the high-temperature and high-humidity atmospheric conditions that the temperature and high-humidity atmospheric conditions that the temperature is 35° C. and the humidity is 85%.

v) The transfer paper having the weight of 64 g/m$^2$ was used and a manuscript having the high black ratio of 50% was subjected to the both-side copying process 4,000 times under the high-temperature and high-humidity atmospheric conditions that the temperature is 35° C. and the humidity is 85%.

In these tests, when the respective separating pawls according to the above described Examples 1 to 4 were used, the separation failure of the transfer paper, the adhering of toners to the respective separating pawls and the generation of black spot-like noises in the copied images were not observed at all.

In addition, such damages that caused white-striped noises and black-striped noises were not observed also in the photosensitive member.

COMPARATIVE EXAMPLE 1

For comparison with the separating pawl according to Example 1, a separating pawl having the same shape as that of the separating pawl according to Example 1 was produced of the polycarbonate resin ((Upilone) S-2000; manufactured by Mitsubishi Gas Kagaku K.K.) and tested similarly to Example 1 in a copying machine installed with negatively chargeable organic photosensitive member. As a result, in the test of the above described condition i), toners adhered to the separating pawl came to fall onto the transfer paper to form black spot-like noises in the copied image after the copying process was repeated 500 times and in the test of the above described condition iii), the separation failure of the transfer paper due to the solidification of toners adhered to the separating pawl occurred after the both-side copying process was repeated 100 times, that is, the 5100th time from the beginning, was conducted.

COMPARATIVE EXAMPLE 2

For comparison with Example 4, Monel metal, which is an alloy of nickel and copper, was processed by means of a grinder to produce a separating pawl having the same shape as that of the separating pawl of Example 1 and tested under the conditions similar to i) to v)

in a copying machine installed with the above described selenium-arsine photosensitive member As a result, in this Comparative Example 2, even though the selenium-arsine photosensitive member having a hard surface was used, striped injuries were formed on the photosensitive member and white striped noises were observed in copied images after the both-side copying process was repeated 300 times under the condition i).

As obvious from these results, the separating pawls formed of the a-C layers according to the above respective Examples could be more suitably used for separating the transfer paper from the photosensitive member in comparison with the separating pawl formed of polycarbonate according to Comparative Example 1 and the separating pawl formed of Monel metal according to Comparative Example 2.

Next, preferred Examples, in which a separating pawl is brought into contact with a fixing roller to separate transfer paper from the fixing roller, are described.

EXAMPLES 5 and 6

Separating pawls were produced under the conditions shown in Table 3.

TABLE 3

| Example No. | 5 | 6 |
|---|---|---|
| substrate | Polyamideimide | Stainless steel |
| Raw material gas | Butadiene | Propylene |
| Flow rate | 200 sccm | 50 sccm<br>Tetrafluorocarbon<br>50 sccm |
| Carrier gas | Hydrogen | Hydrogen |
| Flow rate | 100 sccm | 200 sccm |
| Pressure | 1.2 Torr | 1.0 Torr |
| Frequency of electric power | 1 MHz | 50 KHz |
| Electric power | 100 W | 150 W |
| Temperature of substrate | 200° C. | 250° C. |
| Layer-forming time | 100 min | 5 min |
| Layer-thickness | 5 μm | 0.1 μm |
| Content of C | 57 atomic % | 58 atomic % |
| Content of H | 43 atomic % | 40 atomic % |
| Content of F | | 2 atomic % |

And, the separating pawl produced in the above described Example 5 was used in a copying machine (EP490Z manufactured by Minolta Camera K.K.). The separating pawl produced in Example 6 was used in a copying machine (EP570Z manufactured by Minolta Camera K.K.. As shown in FIG. 9, an edge of the above obtained separating pawl (1) was brought into contact with a surface of a pair of upper and lower fixing rollers (11), (12) installed in a fixing part (10) for fixing a toner image on transfer paper (3) to separate the transfer paper with the toner image fixed thereon from the fixing rollers (11), (12) by means of this separating pawl (1) and send to conveying rollers (13), (14).

Here, a cylindrical aluminum drum, of which surface was coated with a Teflon layer of 0.3 mm in thickness was used as the upper fixing roller, while a cylindrical aluminum drum of which surface was coated with silicon rubber of 5 mm in thickness was used as the lower fixing roller (12).

And, the lower roller (12) was pressed against the upper roller (11) by means of a spring (15) and the transfer paper (3) was subjected to the suitable heat and pressure between the both fixing rollers (11), (12) to fix the toner image om the transfer paper (3). The transfer paper was separated from the fixing rollers (11),(12) by means of the above described separating pawl (1).

Subsequently, the pawl (1) was subjected to the durability test such that the transfer paper (3) is separated from the fixing rollers by means thereof with varying a kind of transfer paper, operating conditions, such as temperature and humidity, and a ratio of toners adhered to the transfer paper and evaluated about the separating performances.

In the above described tests, a both-side copying process was repeated 100,000 times in all in the order of the following respective conditions i) to v).

i) The transfer paper having the weight of 64 g/m$^2$ was used and a manuscript having the black ratio of 6% was subjected to the both-side copying process 40,000 times under the high-temperature and high-humidity atmospheric conditions that the temperature is 20° C. and the humidity is 65%.

ii) The transfer paper having the weight of 64 g/m$^2$ was used and a manuscript having the black ratio of 6% was subjected to the both-side copying process 10,000 times under the high-temperature and high-humidity atmospheric conditions that the temperature is 35° C. and the humidity is 85%.

iii) The transfer paper having the weight of 52 g/m$^2$ was used and a manuscript having the high black ratio of 50% was subjected to the both-side copying process 5000 times under the high-temperature and high-humidity atmospheric conditions that the temperature is 35° C. and the humidity is 85%.

iv) The transfer paper having the weight of 104 g/m$^2$ was used and a manuscript having the high black ratio of 50% was subjected to the both-side copying process 5000 times under the high-temperature and high-humidity atmospheric conditions that the temperature is 35° C. and the humidity is 85%.

v) The transfer paper having the weight of 64 g/m$^2$ was used and a manuscript having the high black ratio of 50% was subjected to the both-side copying process 40000 times under the high-temperature and high-humidity atmospheric conditions that the temperature is 35° C. and the humidity is 85%.

In these tests, when the above described separating pawls were used, the separation failure of the transfer paper (3), the adhering of toners to the separating pawl and the generation of black spot-like noises were not observed at all during the both-side copying process of 100000 times.

Also the wear of the separating pawl, the separation failure of the transfer paper caused by the wear of the separating pawl, the formation of injuries on the fixing rollers and the fixation failure were not observed at all.

COMPARATIVE EXAMPLE 3

In this Comparative Example, a polyamideimide resin represented by the following structural formula [I], was molded so that the obtained molded part might have the same shape as that of the substrate of Example 5. And then, it was abraded by means of a grinder, and the edge portion of the abraded part was finished by hand to obtain a separating pawl.

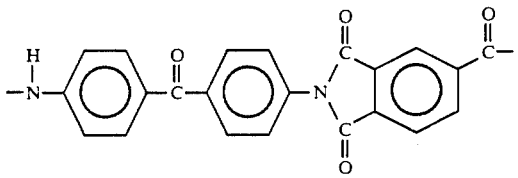

[I]

COMPARATIVE EXAMPLE 4

In this Comparative Example, a separating pawl, which was formed of stainless steels being same as that of Example 6 used as the substrate. It was abraded by means of a grinder, and then finished by hand to obtain a separating pawl.

COMPARATIVE EXAMPLE 5

In this Comparative Example, a surface of the separating pawl formed of stainless steel produced in the above described Comparative Example was coated with fluorine resins and baked to form a fluorine resin layer of 200 μm in thickness thereon and an end of the separating pawl was finished by hand to give the same shape as that of the separating pawl of Example 5.

And, the separating pawls produced according to the the above described Comparative Examples 3 to 5 were used in a copying machine and tested in the order of the above described respective conditions i) to v) to evaluate the separating performances in the same manner as in the separating pawl produced in Example 5.

As a result, in the case where the separating pawl produced according to comparative Example 3 was used, toners were fused and stuck to the separating pawl provided on the side of the upper fixing roller after the both-side copying process was repeated about 35000 times in the above described step i) and the shape of the end portion of the separating pawl was changed with the fusedly stuck toners, resulting in the separation failure of the transfer paper. the both-side copying process was further continued while the toners fusedly stuck to the above described separating pawl were removed properly. Toners came to be fused and stuck to the separating pawl provided on the side of the lower fixing roller after the both-side copying process was repeated about 5000 times in the step v), that is, the both-side copying process was repeated bout 65000 times from the beginning, and thus the separation failure of the transfer paper occurred.

Besides, in the case where the separating pawl produced according to Comparative Example 4 was used, the surface of the fixing roller brought into contact with the separating pawl provided on the side of the upper fixing roller was worn out after the both-side copying process was repeated about 3000 times in the above described step iii), that is, the both side copying process was repeated about 53,000 times from the beginning, and thus the fixation failure occurred in copied images corresponding to the worn portions, and the adhering of fused toners to the separating pawl was observed.

Furthermore, in the case where the separating pawl produced according to Comparative Example 5 was used, fluorine resin coated on the surface of both separating pawls provided on the sides of both upper and lower fixing rollers was worn after the both-side copying process was repeated about 10000 times in the above described step i) and thus an end portion of the separating pawl was changed in shape, resulting in the separation failure of the transfer paper.

As obvious from these results, the separating pawls formed of the a-C layers in Examples 5 and 6 could be more suitably used for separating the transfer paper from the fixing rollers in comparison with the separating pawls prepared in Comparative Examples 3-5.

EXAMPLE 7-12

In these examples, wedge-like separating pawls, all the surfaces of which were coated with a-C layers containing metal atoms, oxygen atoms, nitrogen atoms, atoms of group III, IV or V in the periodic table, were prepared under the conditions shown in Table 4 in the apparatus as shown in FIG. 10. Thus, wedge-like separating pawls (1) formed of the a-C layers all over the surfaces thereof as shown in FIG. 1 was obtained.

The resultant separating pawls were used to separate transfer paper (3) from the surface (2*a*) of the photosensitive member (2) in a manner similar to Example 1. There were as free troubles as in the other examples.

TABLE 4

| Example No. | 7 | 8 | 9 | 10 | 11 | 12 |
|---|---|---|---|---|---|---|
| Substrate | Stainless steel | reinforced glass | reinforced glass | same as in Example 1 | same as in Example 1 | same as in Example 1 |
| Raw material gas | diethyl zinc ($Zn(C_2H_5)_2$) 0.5 sccm | oxygen 80 sccm | nitrogen 60 sccm | phosphine ($PH_3$) 10 sccm | germane ($GeH_4$) 10 sccm | diborane ($B_2H_6$) 10 sccm |
| | ethylene | butadiene | butadiene | butadiene | butadiene | butadiene |
| Flow rate (sccm) | 4.5 sccm | 80 sccm | 80 sccm | 80 sccm | 80 sccm | 80 sccm |
| Carrier gas | hydrogen | hydrogen | hydrogen | hydrogen | hydrogen | hydrogen |
| Flow rate | 200 sccm | 200 sccm | 200 sccm | 200 sccm | 200 sccm | 200 sccm |
| Pressure | 0.1 Torr | 1.2 Torr | 1.2 Torr | 1.2 Torr | 1.2 Torr | 1.2 Torr |
| Frequency of electric power | 300 KHz | 50 KHz | 150 KHz | 150 KHz | 150 KHz | 150 KHz |
| Electric power | 200 W | 200 W | 200 W | 200 W | 200 W | 200 W |
| Temperature of substrate | 250° C. | 50° C. | 50° C. | 50° C. | 50° C. | 50° C. |
| Layer-forming time | 60 min | 15 min | 20 min | 90 min | 90 min | 90 min |
| Layer thickness | 0.7 μm | 0.5 μm | 0.6 μm | 6 μm | 8 μm | 6 μm |
| Content of C | 49 atomic % | 50 atomic % | 49 atomic % | 50 atomic % | 41 atomic % | 50 atomic % |
| Content of H | 45 atomic % | 48 atomic % | 46 atomic % | 47 atomic % | 44 atomic % | 47 atomic % |
| Doping atom | Zn | O | N | P | Ge | B |
| Content of doping atom | 6 atomic % | 2 atomic % | 5 atomic % | 3 atomic % | 15 atomic % | 3 atomic % |

EVALUATION

The separating pawl obtained in Example 7; the volume resistance thereof was $10^4\Omega\cdot$cm. The adherence of toner particles to the separating pawl was not at all observed, even when a negatively chargeable toner or a positively chargeable toner was used.

The separating pawl obtained in Example 8; Even after it was left under conditions of 50° C. in temperature and 90% in relative humidity, the cracking and the separation of the a-C layer were not observed. Separately, a separation pawl was prepared in a manner similar to Example 8 except that the oxygen atoms were not incorporated in the a-C layer. The cracking and the separation of the a-C layer were not observed too.

The separation pawl obtained in Example 9; Even after it was left under conditions of 50° C. in temperature and 90% in relative humidity, the cracking and the separation of a-C layer were not observed. Separately a separating pawl was prepared in a manner similar to Example 9 except that the nitrogen atoms were not incorporated in the a-C layer. The cracking and the separation of the a-C layer were not observed too.

The separating pawl obtained in Example 10 displayed the same performances as those of the separating pawl in Example 1.

The separating pawls obtained in Examples 11 and 12 displayed the same performances as those of the separating pawl in Example 3.

EXAMPLE 13

The undercoat layer of an amorphous silicon layer was formed on an aluminum substrate which is shaped as shown in FIG. 1 under conditions shown in Table 5 in the apparatus as shown in FIG. 10.

TABLE 4

| | |
|---|---|
| Substrate | aluminium |
| Raw materials | silane |
| Flow rate (sccm) | 50 sccm |
| | ethylene |
| | 20 sccm |
| Carrier gas | hydrogen |
| Flow rate | 200 sccm |
| Pressure | 1.0 Torr |
| Frequency of electric power | 13.56 MHz |
| Electric power | 200 W |
| Temperature of substrate | 100° C. |
| Layer-forming time | 3 min. |
| Layer thickness | 0.1 μm |
| Content of C | 20 atomic % |
| Content of H | 18 atomic % |
| Content of Si | 62 atomic % |

Then, an a-C layer was formed on the undercoat layer in a manner similar to Example 1.

The resultant separating pawl was used to separate transfer paper (3) from the surface (2*a*) of the photosensitive member (2) in a manner similar to Example 1. There were as free troubles as in the other examples.

Separately, an a-C layer was formed directly on an aluminum substrate without forming the undercoat layer to obtain a separating pawl. The resultant separating pawl was subjected to the durability test with respect to copy in the same manner as described in Example 1. The a-C layer was separated partially from the substrate. However, the separation became no problem in the practical use.

EXAMPLE 14

In this Example, a photosensitive member with an overcoat layer of an a-C layer was prepared. A separating pawl coated with an a-C layer prepared in a manner similar to the preparation of the overcoat layer of the photosensitive member.

PREPARATION OF ORGANIC PHOTOSENSITIVE MEMBER

One gram of chloro-dian-blue (CDB) as a bisazo pigment, 1 g of polyester resin (V-200; made by Toyobo K.K.) and 78 g of cyclohexanone were taken into a sand-grinder for dispersion for 13 hours. The obtained dispersion solution was applied to a cylindrical aluminium drum (80 mm in diameter and 340 mm in length) by a dipping method so that the layer thickness might be 0.3 μm after dried. Thus a charge generating layer was formed.

Then, 5 g of 4-diethylaminobenzaldehyde-di-phenyl hydrazone (DEH) and 5 g of polycarbonate (K-1300; made by Teijin Kasei K.K.) were dissolved in tetrahydrofuran (THF). The obtained solution was applied onto the charge generating layer so that the layer thickness might be 15 μm after dried. Thus a charge transporting layer was formed on the charge generating layer to obtain an organic photosensitive layer.

A surface protective layer of a-C layer was formed on the obtained photosensitive member by the use of a plasma-equipment shown in FIG. 10. That is, the cylindrical aluminum drum with the organic photosensitive layer was set between the electrodes (735) and (736) in FIG. 10.

The plasma polymerization was carried out under the conditions described below;

| | |
|---|---|
| Flow rate of ethylene gas | 90 sccm |
| Flow rate of $CO_2$ gas | 65 sccm |
| Flow rate of $H_2$ gas | 120 sccm |
| Pressure | 0.8 Torr |
| Frequency of electric power | 13.56 MHz |
| Electric power | 250 Watt |
| Temperature of substrate | 75° C. |
| Layer-forming time | 5 min |
| Layer-thickness | 0.23 μm |
| Content* of | |
| C | about 65 atomic % |
| H | about 33 atomic % |
| O | about 2 atomic % |

*measured by elemental analysis

Thus, the surface protective layer was formed on the photosensitive layer.

On the other hand, an a-C layer was formed on a substrate made of polycarbonate (same used in Example 1) in the same conditions and in the same apparatus as those in the preparation of the surface protective layer on the photosensitive member as above mentioned to prepare a separating pawl coated with the a-C layer.

EVALUATIONS

The resultant separating pawl was subjected to the durability test with respect to copy in a manner similar to Example 1. The separation failure of the transfer paper, the adhering of toners to the separating pawls and the generation of black spot-like noises in the copied images were not observed at all.

In addition, such damages that cause white-striped noises and black-striped noises were not also observed in the photosensitive member.

Further, copying process was repeated 200,000 times under conditions of normal temperature and normal humidity. The same evaluations as above mentioned were carried out. The results were as good as above mentioned.

What is claimed is;

1. A separating device for separating a sheet-like member from a surface of rotatable member in a copying machine, including a separating pawl having a separating portion in engaging contact with the surface of the rotatable member, said separating portion comprising an amorphous carbon.

2. A separating device of claim 1, wherein the amorphous carbon layer comprises hydrogen atoms at the content of 0.1–67 atomic % on the number of all atoms forming the amorphous carbon layer.

3. A separating device of claim 1, wherein the amorphous carbon layer comprises fluorine atoms at the content of 1–67 atomic % on the basis of the number of all atoms forming the amorphous carbon layer.

4. A separating device of claim 1, wherein the amorphous carbon layer comprises metallic atoms at the content of 0.1–30 atomic % on the basis of the number of all atoms forming in the amorphous carbon layer.

5. A separating device of claim 1, wherein the amorphous carbon layer comprises oxygen atoms and/or nitrogen atoms at the content of 0.1–20 atomic % on the basis of the number of all atoms forming the amorphous carbon layer.

6. A separating device of claim 1, wherein the amorphous carbon layer comprises at least one kind of atoms selected from the group consisting of atoms of group III, group IV and group V in the periodic table at the content of 0.01–30 atomic % on the basis of the number of all atoms forming the amorphous carbon layer.

7. A separating device of claim 1, wherein the amorphous carbon layer has a thickness of 0.1–500 μm.

8. A separating device for separating a sheet-like member including a separating pawl in engaging contact with a surface from which the sheet-like member is separated, the contact portion of the separating pawl being composed of amorphous carbon layer.

9. A separating device for separating a sheet-like member clinging firmly to a surface of a photosensitive member driven for revolution, including a separating pawl having a separating edge in engaging contact with a surface of the photosensitive member at a down stream portion along the revolving direction of the photosensitive member, the engaging contact position being away from a position where the sheet-like member clings firmly to the photosensitive member, wherein the separating edge of the separating pawl comprises an amorphous carbon layer.

10. A separating device of claim 9, wherein the amorphous carbon layer is prepared by a plasma-polymerization method.

11. A separating device of claim 9, wherein the amorphous carbon layer comprises hydrogen atoms at the content of 0.1–67 atomic % on the number of all atoms forming the amorphous carbon layer.

12. A separating device of claim 9, wherein the amorphous carbon layer comprises fluorine atoms at the content 1–67 atomic % on the basis of the number of all atoms forming the amorphous carbon layer.

13. A separating device of claim 9, wherein the amorphous carbon layer comprises metallic atoms at the content of 0.1–30 atomic % on the basis of the number of all atoms forming in the amorphous carbon layer.

14. A separating device of claim 9, wherein the amorphous carbon layer comprises oxygen atom and/or nitrogen atom at the content of 0.1–20 atomic % on the basis of the number of all atoms forming the amorphous carbon layer.

15. A separating device of claim 9, wherein the amorphous carbon layer comprises at least one kind of atoms selected from the group consisting of atoms of group III, group IV and group V in the periodic table at the content of 0.01–30 atomic % on the basis of the number of all atoms forming the amorphous carbon layer.

16. A separating device of claim 9, wherein the surface of the photosensitive member is coated with an amorphous carbon layer.

17. A separating device for separating a sheet-like member clinging firmly to a surface of a photosensitive member driven for revolution, including a separating pawl having a separating edge in engaging contact with a surface of the photosensitive member at a down stream position along the revolving direction of the photosensitive member, the engaging contact position being away from a position where the sheet-like member clings firmly to the photosensitive member, wherein the separating pawl comprises a substrate and an amorphous carbon layer on the substrate.

18. A separating device of claim 17, wherein the substrate comprises a resin.

19. A separating device of claim 17, wherein the substrate comprises a metal.

20. A separating device of claim 17, wherein the substrate comprises a glass.

21. A separating deice of claim 17, wherein an undercoating layer is formed between the substrate and the amorphous carbon layer.

22. A separating device for a copying machine wherein an electrostatic latent image passes through a developing region where the electrostatic latent image is developed by a toner to form a toner image and then through a transferring region where the toner image is transferred onto a sheet-like member, comprising;

a separating pawl for separating the sheet-like member from a surface of a photosensitive member; at least a portion of the separating pawl is coated with an amorphous carbon layer, and a means for pressing the portion of the separating pawl coated with the amorphous carbon against the photosensitive member; the means being located at the down stream side to the transferring region along the revolving direction of the photosensitive member.

23. A separating device of claim 22, wherein the means supports the separating pawl so that the separating pawl may move between the first position where the separating pawl is brought into contact with the photosensitive member to separate the sheet-like member from the surface of the photosensitive member and the second position where the separating pawl is retained apart from the photosensitive member.

24. A separating device of claim 22, wherein the means supports the separating pawl so that the separating pawl may be moved at right angle to the revolving direction of the photosensitive member.

25. A fixing device for fixing a toner image onto a sheet-like member comprising;

a pair of fixing rollers, the toner image is fixed onto the sheet-like member during passing through between the fixing rollers, and a separating pawl with a separating edge for separating the sheet-like member from the fixing rollers in engaging contact with the roller with which the toner image is brought into contact, the separating edge comprising an amorphous carbon layer.

26. A fixing device of claim 25, wherein the amorphous carbon layer is prepared by a plasma-polymerization method.

27. A fixing device of claim 25, wherein the amorphous carbon layer comprises hydrogen atoms at the content of 0.1–67 atomic % on the number of all atoms forming the amorphous carbon layer.

28. A fixing device of claim 25, wherein the amorphous carbon layer comprises fluorine atoms at the content of 1–67 atomic % on the basis of the number of all atoms forming the amorphous carbon layer.

29. A fixing device of claim 25, wherein the amorphous carbon layer comprises metallic atoms at the content of 0.1–30 atomic % on the basis of the number of all atoms forming the amorphous carbon layer.

30. A fixing device of claim 25, wherein the amorphous carbon layer comprises oxygen atom and/or nitrogen atom at the content of 0.1–20 atomic % on the basis of the number of all atoms forming the amorphous carbon layer.

31. A fixing device of claim 25, wherein the amorphous carbon layer comprises at least one kind of atoms selected from the group consisting of atoms of group III, group IV and group V in the periodic table at the content of 0.01–30 atomic % on the basis of the number of all atoms forming the amorphous carbon layer.

* * * * *

UNITED STATES PATENT AND TRADEMARK OFFICE

CERTIFICATE OF CORRECTION

PATENT NO. : 5,125,644

DATED : June 30, 1992

INVENTOR(S) : Kenji Masaki, et al.

It is certified that error appears in the above-identified patent and that said Letters Patent is hereby corrected as shown below:

In col. 1, line 22, change "carvature" to --curvature--.

In col. 2, line 65, change "."(period) to --;--(semi-colon).

In col. 2, last line, change "."(period) to --;--(semi-colon).

In col. 3, line 2, change "."(period) to --;--(semi-colon).

In col. 4, line 21, before "most" insert --a--.

In col. 4, line 61, change "a-C lay" to --a-C layer--.

In col. 5, line 4, change "an" to --a--.

In col. 5, line 27, delete "or less".

In col. 5, line 29, after "not" insert --be--.

In col. 5, line 31, change "flexibile" to --flexible--.

In col. 5, line 67, after "atomic" insert --%--.

In col. 6, line 1, change "electric" to --electrical--.

UNITED STATES PATENT AND TRADEMARK OFFICE

CERTIFICATE OF CORRECTION

PATENT NO. : 5,125,644

DATED : June 30, 1992

INVENTOR(S) : Kenji Masaki, et al.

It is certified that error appears in the above-identified patent and that said Letters Patent is hereby corrected as shown below:

In col. 6, line 12, insert the following heading for the Table thereunder -- Metal-containing compounds are exemplified by:--.

In col. 6, line 40, change "$MOCl_6$" to --$MoCl_6$--.

In col. 7, line 37, change "an" to --a--.

In col. 7, line 55, change "rotates" to --rotate--.

In col. 8, line 9, change "cleared" to --cleaner--.

In col. 10, line 21, change "are" to --is--.

In col. 11, line 39, change "Herium" to --Helium--.

In col. 12, lines 25 and 26, delete "that the temperature and high-humidity atmospheric conditions".

In col. 13, line 2, after "member" insert --.-- (period).

In col. 13, line 50, between the two periods ".." insert --)--.

In col. 13, line 57, change "send" to --sent--.

UNITED STATES PATENT AND TRADEMARK OFFICE

CERTIFICATE OF CORRECTION

PATENT NO. : 5,125,644

DATED : June 30, 1992

INVENTOR(S) : Kenji Masaki, et al.

It is certified that error appears in the above-identified patent and that said Letters Patent is hereby corrected as shown below:

In col. 13, last line, change "om" to --on--.

In col. 15, line 27, delete "the".

In col. 15, line 40, change "the"(second occurrence) to --The--.

In col. 16, line 2, change "bout" to --about--.

In col. 17, line 8, change "Even" to --even--.

In col. 17, line 16, change "Even" to --even--.

In col. 18, line 55, after "same" insert --as--.

In col. 19, line 11 (claim 1, line 2), after "of" insert --a--.

In col. 19, line 27 (claim 4, line 4), delete "in".

In col. 20, line 4 (claim 13, line 4), delete "in".

UNITED STATES PATENT AND TRADEMARK OFFICE

CERTIFICATE OF CORRECTION

PATENT NO. : 5,125,644

DATED : June 30, 1992

INVENTOR(S) : Kenji Masaki, et al.

It is certified that error appears in the above-indentified patent and that said Letters Patent is hereby corrected as shown below:

In col. 20, line 36 (claim 21, line 1), change "deice" to —device—.

Signed and Sealed this

Second Day of November, 1993

Bruce Lehman

*Attest:*

BRUCE LEHMAN

*Attesting Officer*

*Commissioner of Patents and Trademarks*